US012392092B1

(12) United States Patent
Cao et al.

(10) Patent No.: US 12,392,092 B1
(45) Date of Patent: Aug. 19, 2025

(54) DEVICE AND CONSTRUCTION METHOD FOR AUTOMATICALLY PLACING HIGH-SPEED RAILWAY STEEL RAIL LAYING TIE PLATE

(71) Applicants: China Railway First Group Co., Ltd, Xi'an (CN); China Railway First Group Xinyun Engineering Co., Ltd, Xianyang (CN)

(72) Inventors: Dezhi Cao, Xianyang (CN); Hongbin Cai, Xianyang (CN); Lei Zhang, Xianyang (CN); Wenhu Li, Xianyang (CN); Lifeng Ma, Xianyang (CN); Shuzhi Xiang, Xianyang (CN); Qifeng Sun, Xianyang (CN); Zhu Wen, Xianyang (CN); Junhong Sun, Xianyang (CN); Jun Yang, Xianyang (CN)

(73) Assignees: China Railway First Group Co., Ltd, Xi'an (CN); China Railway First Group Xinyun Engineering Co., Ltd, Xianyang (CN)

( * ) Notice: Subject to any disclaimer, the term of this patent is extended or adjusted under 35 U.S.C. 154(b) by 0 days.

(21) Appl. No.: 19/083,544

(22) Filed: Mar. 19, 2025

(30) Foreign Application Priority Data

Apr. 8, 2024 (CN) ..... 202410411877.3

(51) Int. Cl.
*E01B 29/32* (2006.01)

(52) U.S. Cl.
CPC ..... *E01B 29/32* (2013.01)

(58) Field of Classification Search
CPC ..... E01B 29/32; E01B 31/02
See application file for complete search history.

(56) References Cited

U.S. PATENT DOCUMENTS 4,974,518 A * 12/1990 Cotic ..... E01B 29/32 198/395
5,655,455 A * 8/1997 Smith ..... E01B 29/32 104/16

(Continued)

FOREIGN PATENT DOCUMENTS

CA 2814607 A1 4/2014
CN 101245579 A 8/2008

(Continued)

OTHER PUBLICATIONS

Hongliang Wang, CRTS I double-block ballasted rail track frame method construction in the Tunnel, Railway Engineering, 2012, pp. 81-84, vol. 4.

(Continued)

*Primary Examiner* — Robert J McCarry, Jr.
(74) *Attorney, Agent, or Firm* — Bayramoglu Law Offices LLC

(57) ABSTRACT

The provided is a device and construction method for automatically placing a high-speed railway steel rail laying tie plate. The device includes a walking device, clamping devices and a plate dispersing device; the plate dispersing device is connected to a rear of the walking device; the clamping devices are arranged at two sides of the walking device; and the walking device and the plate dispersing device are both arranged on the rail plate, and a walking route of the walking device is parallel to the rail plate. Also provided is a construction method, including specific steps: arranging a walking device and a plate dispersing device; assembling a clamping device, clamping a clamping groove, adjusting a clamping arm adjusting bolt, and then tightening a locking nut; connecting the plate dispersing device to a frame; turning on the walking device, controlling a walking direction of the walking device, and dispersing plates.

12 Claims, 4 Drawing Sheets

(56) References Cited

U.S. PATENT DOCUMENTS

| | | | | |
|---|---|---|---|---|
| 6,807,909 | B1 * | 10/2004 | Coots | B60P 1/36 104/16 |
| 8,443,733 | B2 * | 5/2013 | Coots | E01B 29/32 104/5 |
| 8,528,484 | B2 * | 9/2013 | Helmick | E01B 29/32 104/2 |
| 9,446,662 | B2 * | 9/2016 | Coots | B60K 25/06 |
| 2011/0100248 | A1 | 5/2011 | Buckley et al. | |
| 2018/0223482 | A1 | 8/2018 | Hamilton et al. | |
| 2019/0382962 | A1 | 12/2019 | Coots | |
| 2020/0141065 | A1 | 5/2020 | Coots | |
| 2021/0222374 | A1 | 7/2021 | Bokenkamp et al. | |

FOREIGN PATENT DOCUMENTS

| | | | |
|---|---|---|---|
| CN | 207391963 | U | 5/2018 |
| CN | 110565458 | A | 12/2019 |
| CN | 212652764 | U | 3/2021 |
| CN | 213925688 | U | 8/2021 |
| CN | 117166301 | A | 12/2023 |
| CN | 117230667 | A | 12/2023 |
| WO | 2017121044 | A1 | 7/2017 |

OTHER PUBLICATIONS

Qing San-Hui, Researches on the Key Construction Equipments and Technologies for CRTS II Slab Ballastless Track for High-speed Railway, Journal of Railway Engineering Society, 2008, pp. 22-27 No. 7 Ser. 118.

* cited by examiner

DEVICE AND CONSTRUCTION METHOD FOR AUTOMATICALLY PLACING HIGH-SPEED RAILWAY STEEL RAIL LAYING TIE PLATE

CROSS-REFERENCE TO THE RELATED APPLICATIONS

This application is based upon and claims priority to Chinese Patent Application No. 202410411877.3, filed on Apr. 8, 2024, the entire contents of which are incorporated herein by reference.

TECHNICAL FIELD

The present invention relates to the technical field of railway construction, and more specifically relates to a device and construction method for automatically placing a high-speed railway steel rail laying tie plate.

BACKGROUND

After the construction of the high-speed railway rail plate is completed, parts for fixing steel rails, such as a tie plate, an elastic strip and a bolt, need to be mounted on the rail plate. Handling and installation of these parts are currently carried on trolleys or riding tricycles and can only be run in the middle of bidirectional rails. The weight of the elastic strip and bolt is relatively light and the labor intensity is not high; however, the weight of a single piece of a tie plate is 6 kg, and a tricycle with a load capacity of 600 kg can load up to 100 pieces at a time. Due to the fact that high-speed railway is formed by splicing rail plates one by one, 18 tie plates are placed on each rail plate, resulting in 36 tie plates in both directions. Each tricycle can be only equipped with tie plates which is used for mounting the lengths of three rail plates. A tricycle is continuously transported and placed by 4-5 workers, and is transported by a reloader; the labor intensity is very high. Due to the fact that the transportation of dispersing plates by tricycles is placed on the inside of the two-way lane, it needs to be transported to the mounting position for a second time, which seriously affects the construction progress. Furthermore, the function of the tie plate is to fill and adjust a height difference on a rail caused by the shape of the foundation and the unevenness of the ground, so as to maintain the flatness of the rail; and a large error easily occurs when the tie plate is manually placed at a predetermined position of a rail plate sleepers, so that the problem of missing or misplacement exists, the efficiency is low, and the problem rate is high.

The invention of CN117166301A in the prior art discloses a construction device for an automatic ballastless rail elevation tie block. By arranging a walking device and multiple groups of feeding components, the tie blocks are distributed to the corresponding sleepers, but the corresponding positions of the tie blocks and sleepers cannot be controlled. During the process of discharging and falling the tie blocks, it is easy to cause left and right misalignment, resulting in a decrease in construction efficiency. Therefore, how to provide a device and construction method capable of walking on a rail plate and automatically positioning automatically dispersing plates is a problem to be solved urgently by a person skilled in the art.

SUMMARY

In view of this, provided in the present invention is a device and construction method for automatically placing a high-speed railway steel rail laying tie plate. The present invention solves the problems in the prior art that the discharge of a tie block is staggered and the construction efficiency is low, and has the advantages of automatic positioning, automatic plate dispersing and high construction efficiency.

In order to achieve the above object, the present invention adopts the following technical solutions:

A device for automatically placing a high-speed railway steel rail laying tie plate, comprising a walking device, clamping devices and a plate dispersing device; wherein the plate dispersing device is connected to a rear of the walking device; the clamping devices are arranged at two sides of the walking device; the walking device and the plate dispersing device are both arranged on a rail plate, a walking route of the walking device is parallel to the rail plate, and the clamping devices are arranged at two sides of the rail plate and used for clamping the rail plate.

Further, the walking device comprises a transport headstock, a frame, a power structure and a walking wheel structure, and the transport headstock is arranged above the frame; the walking wheel structure is arranged below the frame, and is connected to the transport headstock by means of the power structure; and the walking wheel structure comprises at least two groups of walking wheels walking in parallel along rail plate sleepers.

Further, at least three groups of clamping devices are arranged at two sides of the walking device, and two clamping devices are symmetrically arranged in each group and clamp the rail plate from the two sides; each clamping device comprises a clamping arm, a clamping arm adjusting bolt, a locking nut, a clamping wheel and a clamping wheel frame; an upper end of the clamping arm is connected to the walking device by means of the clamping arm adjusting bolt; the locking nut is rotatably connected to the clamping arm adjusting bolt and is used for locking the clamping arm adjusting bolt; a lower end of the clamping arm is fixedly connected to the clamping wheel frame; the clamping wheel is rotatably connected within the clamping wheel frame; the clamping wheel is arranged on a side surface of the rail plate and moves along the side surface of the rail plate; a clamping groove is formed at one side of a middle of the clamping arm close to the walking device, a clamping arm supporting pin is fixedly arranged at a side surface of the walking device, and the clamping groove and the clamping arm supporting pin cooperate to fix the clamping arm and the walking device.

Further, the plate dispersing device is rotatably connected to a rear end of the walking device by means of a plate dispersing rotating shaft; the plate dispersing device comprises a movable support, a conveying device and an arrangement device; the movable support is fixedly connected to the conveying device; and the arrangement device is fixedly connected to the conveying device.

Further, the movable support comprises a support and a support wheel set; the support wheel set is arranged below the support and is used for walking of the movable support; the movable support is arranged between two rail plate sleepers; the support wheel set is provided with at least three groups of support wheels; and each group of support wheels is symmetrically arranged on two sides of the support.

Further, the conveying device comprises the slideway and a hopper; the slideway is obliquely arranged, a head end thereof is rotatably connected to the walking device, a tail end thereof is rotatably connected to the arrangement device, and a middle part thereof is fixedly connected to the support; and the hopper is fixedly arranged at an upper end of the slideway.

Further, an arrangement device comprises a material-blocking structure and a rotating arm structure; the material-blocking structure is rotatably connected to a slideway and used for supporting a tie plate; and the rotating arm structure is rotatably connected to the material-blocking structure, and is used for tilting the material-blocking structure to enable the tie plate to fall down.

Further, the material-blocking structure comprises a material-blocking and pressing arm, a material-blocking and pressing arm shaft, a baffle, a pressing spring and a reset spring; the material-blocking and pressing arm is L-shaped, and a middle of the material-blocking and pressing arm is rotatably connected to the slideway by means of the material-blocking and pressing arm shaft; an upper end of the material-blocking and pressing arm is provided with a groove, a through-hole is formed on the slideway, and the pressing spring penetrates through the through-hole and is fixedly connected to an inner wall of the groove; the slideway is provided with the baffle at the other side of the material-blocking and pressing arm, and a middle line of the baffle is collinear with a central axis of the pressing spring; the reset spring is arranged on one side of the material-blocking and pressing arm shaft away from the pressing spring and is used for reset buffering of the material-blocking and pressing arm; and an inner wall of one end of the corner of the material-blocking and pressing arm is provided with a shock-absorbing rubber pad.

Further, the rotating arm structure comprises a pressing wheel, a rotating shaft, a rotating arm and a rotating arm wheel, wherein the rotating arm is rotatably connected to the slideway by means of the rotating shaft; the pressing wheel is rotatably connected to one end of the rotating arm, and the rotating arm wheel is rotatably connected to the other end of the rotating arm; and the pressing wheel is arranged between the material-blocking structure and the slideway.

A construction method for automatically placing a high-speed railway steel rail laying tie plate, comprising: arranging a walking device and a plate dispersing device on a rail plate, and arranging the plate dispersing device and a slideway at a position in line with rail plate sleepers; assembling a clamping device, clamping a clamping groove on a clamping arm on a clamping arm supporting pin, adjusting a clamping arm adjusting bolt to a clamping rail plate of a clamping wheel, and tightening a locking nut to fix the clamping arm adjusting bolt, so as to complete mounting of the clamping arm; connecting the plate dispersing device to a frame by means of a plate dispersing rotating shaft to start a plate dispersing operation; turning on the walking device by a headstock worker, controlling a walking direction of the walking device by means of the clamping devices, and placing via the plate dispersing device, tie plates on the rail plate sleepers via cooperation operation of a material-blocking structure and a rotating arm structure so as to complete arrangement of the tie plates.

The present invention has the following beneficial effects: provided in the present invention are a device and construction method for automatically placing a high-speed railway steel rail laying tie plate. The traditional manual plate dispersing is changed to the automatic plate dispersing. A walking device drives the plate dispersing device to automatically place the tie plate on a rail plate tie plate, so as to complete the plate dispersing, thereby not only increasing the laying efficiency of a rail, reducing the labor intensity of workers, but also greatly improving the construction safety and accuracy, and effectively reducing the labor costs. By arranging clamping devices at two sides of a frame, and clamping a rail plate from the two sides by means of a clamping arm and a clamping wheel, a walking device is controlled to always walk along the rail plate, which also ensures that a slideway is always located above rail plate sleepers, thereby solving the problem in the prior art that accurate placement of tie plates cannot be ensured, and further increasing the construction efficiency.

BRIEF DESCRIPTION OF THE DRAWINGS

To describe the technical solutions in the embodiments of the present invention or in the prior art more clearly, the following briefly introduces the accompanying drawings required for describing the embodiments or the prior art. Apparently, the accompanying drawings in the following description show merely embodiments of the present invention, and other drawings may also be obtained according to the provided drawings without creative efforts.

In the drawings.

1—Transport headstock
2—Tie plate
3—Hopper
4—Slideway
5—Support
6—Baffle
7—Pressing spring
8—Material-blocking and pressing arm
9—Material-blocking and pressing arm shaft
10—Reset spring
11—Pressing wheel
12—Rotating shaft
13—Shock-absorbing rubber pad
14—Rotating arm
15—Rotating arm wheel
16—Support wheel set
17—Rail plate sleeper
18—Clamping arm
19—Clamping arm supporting pin
20—Rubber tires for transport vehicle
21—Damping spring for transport vehicle
22—Clamping wheel
23—Clamping wheel frame
24—Transport frame
25—Clamping arm adjusting bolt
26—Locking nut
27—Rail plate
28—Clamping groove
29—Plate dispersing rotating shaft
30—Support wheel
31—Gap between rail plates

DETAILED DESCRIPTION OF THE EMBODIMENTS

The following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by persons of ordinary skill in the art based on the embodiments of the present invention without creative efforts shall belong to the scope of protection of the present invention.

Figure 1:
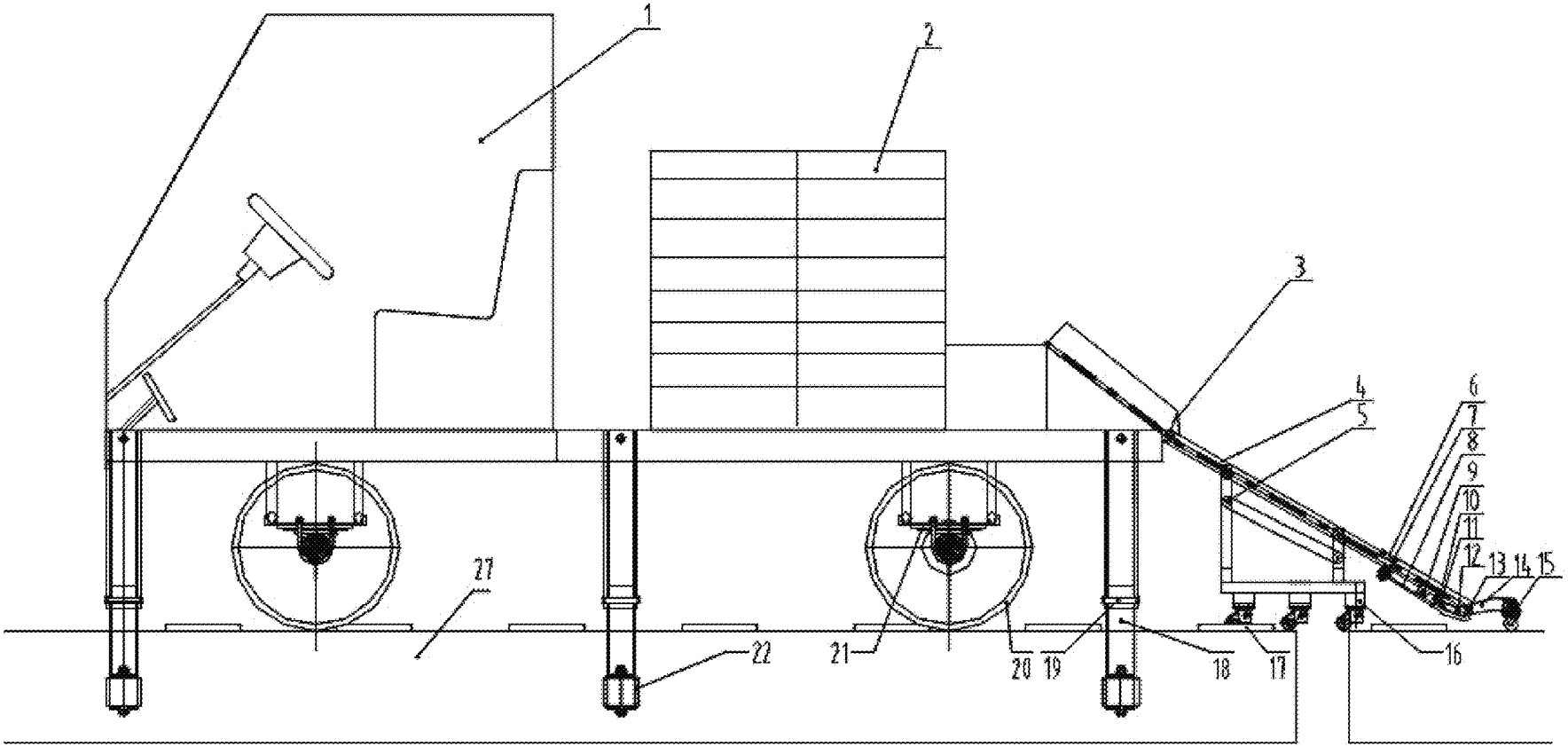
FIG. 1 is a schematic diagram of the overall structure of the present invention.
Figure 2:
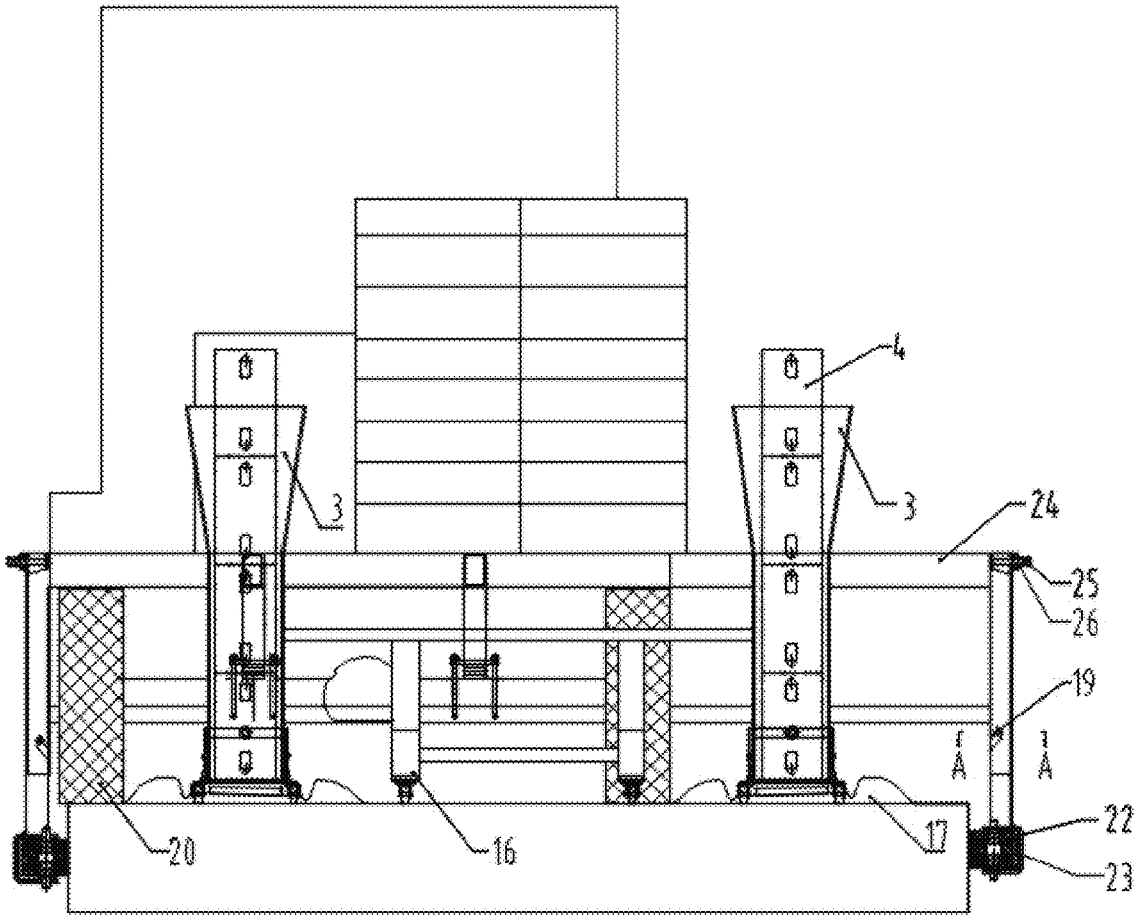
FIG. 2 is a rear view of the present invention.
Figure 3:
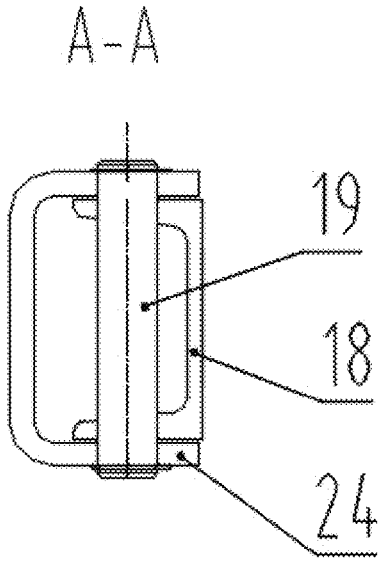
FIG. 3 is a cross-sectional view taken along line A-A in FIG. 2.
Figure 4:
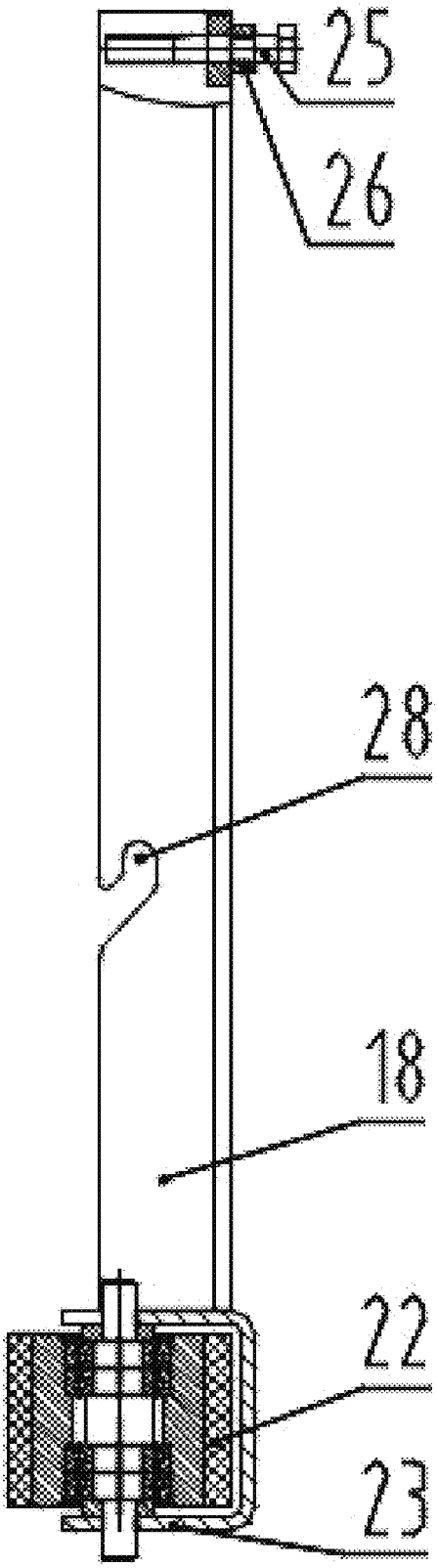
FIG. 4 is a schematic diagram of a clamping device of the present invention.
Figure 5:
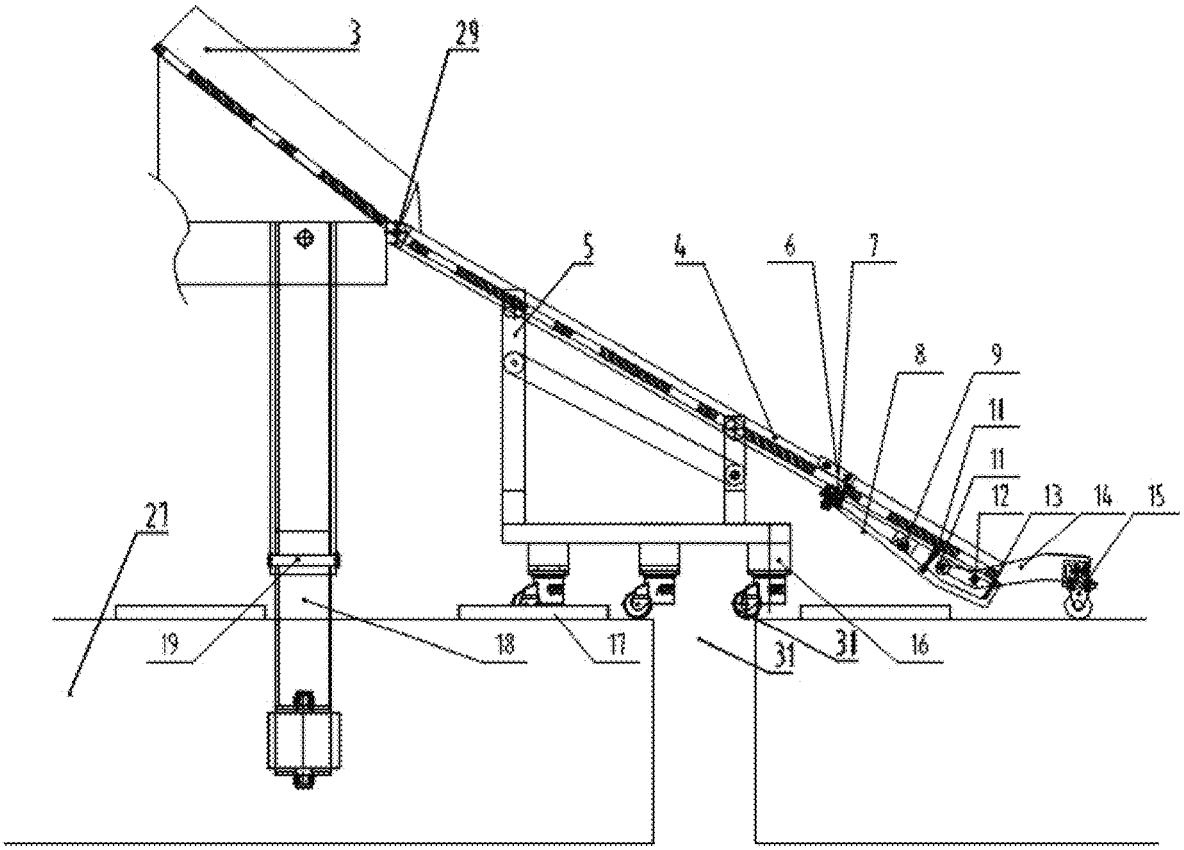
FIG. 5 is a schematic structural diagram of a plate dispersing device according to an embodiment of the present invention.

Please refer to FIGS. 1-5, provided the present invention is a device for automatically placing a high-speed railway steel rail laying tie plate, comprising a walking device, clamping devices and a plate dispersing device; the plate dispersing device is connected to a rear of the walking device; the clamping devices are arranged at two sides of the walking device; the walking device and the plate dispersing device are both arranged on a rail plate 27, a walking route of the walking device is parallel to the rail plate 27, and the clamping devices are arranged at two sides of the rail plate 27 and used for clamping the rail plate 27 to play a limiting role.

The walking device comprises a transport headstock 1, a frame 24, a power structure and a walking wheel structure, and the transport headstock 1 is arranged above the frame 24; a tie plate 2 and a worker are placed above the frame 24 behind the transport headstock 1. The walking wheel structure is arranged below the frame 24, and is connected to the transport headstock 1 by means of a power structure; a damping spring 21 for a transport vehicle is further provided between the walking wheel structure and the frame 24 for damping the vehicle body, so as to avoid affecting the operation of the plate dispersing device on the rear. The walking wheel structure comprises at least two groups of walking wheels 20. Each group of the walking wheels 20 comprises two walking wheels 20. The two walking wheels 20 are both provided on one side of the two rail plate sleepers 17, and walk in parallel along rail plate sleepers 17.

At least three groups of clamping devices are arranged on two sides of the frame 24 and the rail plate 27, and two clamping devices are symmetrically arranged in each group and clamp the rail plate 27 from two sides.

Each clamping device comprises a clamping arm 18, a clamping arm adjusting bolt 25, a locking nut 26, a clamping wheel 22 and a clamping wheel frame 23.

An upper end of the clamping arm 18 is connected to the frame 24 by means of the clamping arm adjusting bolt 25; the locking nut 26 is rotatably connected to the clamping arm adjusting bolt 25 and is used for locking the clamping arm adjusting bolt 25; a lower end of the clamping arm 18 is fixedly connected to the clamping wheel frame 23; the clamping wheel 22 is rotatably connected within the clamping wheel frame 23; the clamping wheel 22 is arranged on a side surface of the rail plate 27 and moves along the side surface of the rail plate 27. The clamping arm adjusting bolt 25 can adjust the tightness of the clamping wheel 22 clamping the rail plate 27. A clamping groove 28 is formed at one side of a middle of the clamping arm 18 close to the frame 24, a clamping arm supporting pin 19 is fixedly arranged at a side surface of the frame 24, and the clamping arm 18 and the frame 24 cooperate to fix the clamping groove 28 and the clamping arm supporting pin 19.

The walking device is placed on the rail plate 27 and walks along the rail plate 27. The clamping arm 18 clamps the clamping groove 28 onto the clamping arm supporting pin 19, adjusts the clamping arm adjusting bolt 25, clamps the two clamping wheels 22 from two sides of the rail plate 27, locks the locking nut, and completes the mounting of the clamping arm 18.

A rear end of the frame 24 is rotatably connected to the plate dispersing device by means of a plate dispersing rotating shaft 29. The plate dispersing device comprises a movable support, a conveying device and an arrangement device. The movable support is fixedly connected to the conveying device; and the arrangement device is fixedly connected to the conveying device.

The movable support comprises a support 5 and a support wheel set 16; the support wheel set 16 is arranged below the support 5 and is used for walking of the movable support; and the movable support is arranged between two rail plate sleepers 17. There is a gap of 80-180 mm between the front and rear of the laid rail plate 27, at least three groups of support wheels 30 are provided on the support wheel set 16, and the distance between each group of support wheels 30 is 200 mm, so as to prevent the movable support from being stuck at the rail plate gap 30 or making the cushion plate 2 fall off due to jolt; and each group of support wheels 30 is arranged symmetrically on both sides of the support frame 5.

The conveying device comprises the slideway 4 and a hopper 3, in which the slideway 4 is obliquely arranged, a head end thereof is rotatably connected to the frame 24*b* means of the plate dispersing rotating shaft 29, a tail end thereof is rotatably connected to the arrangement device, and a middle portion thereof is fixedly connected to the support 5; the hopper 3 is fixedly arranged at an upper end of the slideway 4 and laps over an operation platform for a worker to put the tie plate 2 in. The dispersing plate device is rotatably connected to the frame 24 by means of the slideway 4, a worker puts a tie plate 2 into the hopper 3 above the slideway 4 on the frame 24, the tie plate 2 moves downwards along the slideway 4, and is distributed to the rail plate sleepers 17 by means of the arrangement device.

An arrangement device comprises a material-blocking structure and a rotating arm structure; the material-blocking structure is rotatably connected to a slideway 4 and used for supporting a tie plate 2; and the rotating arm structure is rotatably connected to the material-blocking structure, and is used for tilting the material-blocking structure to enable the tie plate 2 thereon to fall down.

The material-blocking structure comprises a material-blocking and pressing arm 8, a material-blocking and pressing arm shaft 9, a baffle 6, a pressing spring 7 and a reset spring 10; the material-blocking and pressing arm 8 is L-shaped, and a middle of the material-blocking and pressing arm 8 is rotatably connected to the slideway 4 by means of the material-blocking and pressing arm shaft 9; the material-blocking and pressing arm 8 is obliquely arranged together with the slide way 4, an upper end of the material-blocking and pressing arm 8 is provided with a groove, a through-hole is formed on the slideway 4, and the pressing spring 7 penetrates through the through-hole and is fixedly connected to an inner wall of the groove; the slideway 4 is provided with the baffle 6 at the other side of the material-blocking and pressing arm 8, and a middle line of the baffle 6 is collinear with a central axis of the pressing spring 7; the reset spring 10 is arranged on one side of the material-blocking and pressing arm shaft 9 away from the pressing spring 7 and is used for reset buffering of the material-blocking and pressing arm 8. An inner wall of one end of the corner of the material-blocking and pressing arm 8 is provided with a shock-absorbing rubber pad 13, thereby preventing the tie plate 2 from colliding with the material-blocking and pressing arm 8 to cause damage when the tie plate 2 slides downwards. The tie plate 2 slides to a corner position of the material-blocking and pressing arm 8 by means of a slideway 4, and the material-blocking and pressing arm 8 prevents the tie plate 2 from dropping down.

The rotating arm structure comprises a pressing wheel 11, a rotating shaft 12, a rotating arm 14 and a rotating arm wheel 15; the rotating arm 14 is rotatably connected to the slideway 4 by means of the rotating shaft 12; the pressing wheel 11 is rotatably connected to one end of the rotating arm 14, and the rotating arm wheel 15 is rotatably connected to the other end of the rotating arm 14; and the pressing wheel 11 is arranged between the material-blocking structure 8 and the slideway 4.

When the movable support drives the arrangement device to move forward, the rotating arm wheels 15 lift upward due to the landing difference between the rail plate 27 and the rail plate sleepers 17, the rotating arm 14 rotates along the rotating shaft 12, so that the pressing wheel 11 presses down one end of the corner of the material-blocking and pressing arm 8, the other end of the material-blocking and pressing arm 8 compresses the pressing spring 7, so that the pressing spring 7 presses the tie plate 2 tightly against the baffle 6. With the rotation of the material-blocking and pressing arm 8, one end of the corner of the material-blocking and pressing arm 8 opens one end of the slideway 4 downwards, the tie plate 2 is dropped onto the rail plate sleepers 17. After the tie plate 2 is dropped, the corner end of the material-blocking and pressing arm 8 is reset to close the slideway 4 due to the effect of the reset spring 10.

Provided in the present invention is a construction method for automatically placing a high-speed railway steel rail laying tie plate, comprising the following specific steps.

A worker arranges a walking device and a plate dispersing device on a rail plate 27, and arranges the plate dispersing device and a slideway at a position in line with rail plate rail sleepers 17. After assembling the clamping device, a worker clamps the clamping groove 28 on the clamping arm 18 on the clamping arm supporting pin 19, adjusts the clamping arm adjusting bolt 25 to an appropriate position, and tightening the locking nut 26 to fix the clamping arm adjusting bolt 25, so as to complete mounting of the clamping arm 18. A worker connects the plate dispersing device to the frame 24 by means of the plate dispersing rotating shaft 29 to start the plate dispersing operation. A vehicle headstock worker turns on the walking device, and clamping devices control a walking direction of the walking device, so as to ensure that a channel of a plate dispersing device is always located on rail plate sleepers. The plate dispersing device places a tie plate on the rail plate sleepers 17 by means of the cooperation operation of a material-blocking structure and a rotating arm structure, so as to complete arrangement of the tie plates.

The embodiments in this description are described in a progressive manner, each embodiment focuses on a difference from other embodiments, and reference may be made to each other for the same or similar parts of the embodiments. Since the device disclosed in the embodiment corresponds to the method disclosed in the embodiment, the description thereof is relatively simple, and for the relevant parts, reference can be made to the description of the method.

The foregoing descriptions of the disclosed embodiments enable persons skilled in the art to implement or use the present invention. Various modifications to these embodiments will be readily apparent to persons skilled in the art. The general principles defined herein may be implemented in other embodiments without departing from the spirit or scope of the invention. Therefore, the present invention will not be limited to the embodiments described herein but is to be accorded the widest scope consistent with the principles and novel features disclosed herein.

What is claimed is:

1. A device for automatically laying a high-speed railway steel rail tie plate, comprising:

a walking device, clamping devices and a plate dispersing device; wherein the plate dispersing device is connected to a rear of the walking device; the clamping devices are arranged at two sides of the walking device; the walking device and the plate dispersing device are both arranged on a rail plate, a walking route of the walking device is parallel to the rail plate, and the clamping devices are arranged at two sides of the rail plate and are configured for clamping the rail plate;

an arrangement device comprises a material-blocking structure and a rotating arm structure; the material-blocking structure is rotatably connected to a slideway and is configured for supporting a tie plate; and the rotating arm structure is rotatably connected to the material-blocking structure, and is configured for tilting the material-blocking structure to enable the tie plate to fall down;

the material-blocking structure comprises a material-blocking and pressing arm, a material-blocking and pressing arm shaft, a baffle, a pressing spring and a reset spring; the material-blocking and pressing arm is L-shaped, and a middle of the material-blocking and pressing arm is rotatably connected to the slideway by means of the material-blocking and pressing arm shaft; an upper end of the material-blocking and pressing arm is provided with a groove, a through-hole is formed on the slideway, and the pressing spring penetrates through the through-hole and is fixedly connected to an inner wall of the groove; the slideway is provided with the baffle at a second side of the material-blocking and pressing arm, and a middle line of the baffle is collinear with a central axis of the pressing spring; the reset spring is arranged on a first side of the material-blocking and pressing arm shaft away from the pressing spring and is configured to reset buffering of the material-blocking and pressing arm; and an inner wall of one end of a corner of the material-blocking and pressing arm is provided with a shock-absorbing rubber pad; and the rotating arm structure comprises a pressing wheel, a rotating shaft, a rotating arm and a rotating arm wheel, wherein the rotating arm is rotatably connected to the slideway by means of the rotating shaft; the pressing wheel is rotatably connected to a first end of the rotating arm, and the rotating arm wheel is rotatably connected to a second end of the rotating arm; and the pressing wheel is arranged between the material-blocking structure and the slideway.

2. The device for automatically laying a high-speed railway steel rail tie plate according to claim 1, wherein the walking device comprises a transport headstock, a frame, a power structure and a walking wheel structure, and the transport headstock is arranged above the frame; the walking wheel structure is arranged below the frame, and is connected to the transport headstock by means of the power structure; and the walking wheel structure comprises at least two sets of walking wheels configured to walk in parallel along rail plate sleepers.

3. The device for automatically laying a high-speed railway steel rail tie plate according to claim 1, wherein at least three groups of clamping devices are arranged at two sides of the walking device, and two clamping devices are symmetrically arranged in each group of clamping devices and clamp the rail plate from two sides; each clamping device comprises a clamping arm, a clamping arm adjusting bolt, a locking nut, a clamping wheel and a clamping wheel frame; an upper end of the clamping arm is connected to the walking device by means of the clamping arm adjusting bolt; the locking nut is rotatably connected to the clamping arm adjusting bolt and is configured to lock the clamping arm adjusting bolt; a lower end of the clamping arm is fixedly connected to the clamping wheel frame; the clamping wheel is rotatably connected within the clamping wheel frame; the clamping wheel is arranged on a side surface of the rail plate and is configured to move along the side surface of the rail plate; a clamping groove is formed at one side of a middle of the clamping arm adjacent to the walking device, a clamping arm supporting pin is fixedly arranged at a side surface of the walking device, and the clamping groove and the clamping arm supporting pin cooperate to fix the clamping arm and the walking device.

4. The device for automatically laying a high-speed railway steel rail tie plate according to claim 1, wherein the plate dispersing device is rotatably connected to a rear end of the walking device by means of a plate dispersing rotating shaft; the plate dispersing device comprises a movable support, a conveying device and the arrangement device; the movable support is fixedly connected to the conveying device; and the arrangement device is fixedly connected to the conveying device.

5. The device for automatically laying a high-speed railway steel rail tie plate according to claim 4, wherein the movable support comprises a support and a support wheel set; the support wheel set is arranged below the support and is configured to walk the movable support; the movable support is arranged between two rail plate sleepers; the support wheel set is provided with at least three groups of support wheels; and each of the at least three groups of support wheels are symmetrically arranged on two sides of the support.

6. The device for automatically laying a high-speed railway steel rail tie plate according to claim 4, wherein the conveying device comprises the slideway and a hopper; the slideway is obliquely arranged, a head end of the slideway is rotatably connected to the walking device, a tail end of the slideway is rotatably connected to the arrangement device, and a middle of the slideway is fixedly connected to a support; and the hopper is fixedly arranged at an upper end of the slideway.

7. A construction method for automatically laying a high-speed railway steel rail tie plate, wherein construction is completed by means of the device for automatically laying a high-speed railway steel rail tie plate according to claim 1, and the construction method comprises:

arranging the walking device and the plate dispersing device on the rail plate, and arranging the plate dispersing device and the slideway at a position in line with rail plate sleepers; assembling the clamping device, clamping a clamping groove on a clamping arm on a clamping arm supporting pin, adjusting a clamping arm adjusting bolt to a clamping rail plate of a clamping wheel, and tightening a locking nut to fix the clamping arm adjusting bolt to complete mounting of the clamping arm; connecting the plate dispersing device to a frame by means of a plate dispersing rotating shaft to start a plate dispersing operation; turning on the walking device by a headstock worker, controlling a walking direction of the walking device by means of the clamping devices, and placing via the plate dispersing device, the tie plates on the rail plate sleepers in cooperation with the material-blocking structure and the rotating arm structure to complete arrangement of the tie plates.

8. The construction method according to claim 7, wherein in the device for automatically laying a high-speed railway steel rail tie plate according to claim 1, the walking device comprises a transport headstock, the frame, a power structure and a walking wheel structure, and the transport headstock is arranged above the frame; the walking wheel structure is arranged below the frame and is connected to the transport headstock by means of the power structure; and the walking wheel structure comprises at least two sets of walking wheels walking in parallel along the rail plate sleepers.

9. The construction method according to claim 7, wherein in the device for automatically laying a high-speed railway steel rail tie plate according to claim 1, at least three groups of clamping devices are arranged at two sides of the walking device, and two clamping devices are symmetrically arranged in each group and clamp the rail plate from two sides; each clamping device comprises the clamping arm, the clamping arm adjusting bolt, the locking nut, the clamping wheel and a clamping wheel frame; an upper end of the clamping arm is connected to the walking device by means of the clamping arm adjusting bolt; the locking nut is rotatably connected to the clamping arm adjusting bolt and is configured for locking the clamping arm adjusting bolt; a lower end of the clamping arm is fixedly connected to the clamping wheel frame; the clamping wheel is rotatably connected within the clamping wheel frame; the clamping wheel is arranged on a side surface of the rail plate and moves along the side surface of the rail plate; the clamping groove is formed at one side of a middle of the clamping arm adjacent to the walking device, the clamping arm supporting pin is fixedly arranged at a side surface of the walking device, and the clamping groove and the clamping arm supporting pin cooperate to fix the clamping arm and the walking device.

10. The construction method according to claim 7, wherein in the device for automatically laying a high-speed railway steel rail tie plate according to claim 1, the plate dispersing device is rotatably connected to a rear end of the walking device by means of the plate dispersing rotating shaft; the plate dispersing device comprises a movable support, a conveying device and the arrangement device; the movable support is fixedly connected to the conveying device; and the arrangement device is fixedly connected to the conveying device.

11. The construction method according to claim 10, wherein in the device for automatically laying a high-speed railway steel rail tie plate according to claim 1, the movable support comprises a support and a support wheel set; the support wheel set is arranged below the support and is configured for walking of the movable support; the movable support is arranged between two rail plate sleepers; the support wheel set is provided with at least three groups of support wheels; and each group of the at least three groups of support wheels are symmetrically arranged on two sides of the support.

12. The construction method according to claim 10, wherein in the device for automatically laying a high-speed railway steel rail tie plate according to claim 1, the conveying device comprises the slideway and a hopper; the slideway is obliquely arranged, a head end of the slideway is rotatably connected to the walking device, a tail end of the slideway is rotatably connected to the arrangement device, and a middle of the slideway is fixedly connected to a support; and the hopper is fixedly arranged at an upper end of the slideway.

* * * * *